US006031889A

United States Patent [19]

Toyota

[11] Patent Number: 6,031,889

[45] Date of Patent: Feb. 29, 2000

[54] ACOUSTIC DELAY LINE WITH MOVABLE PARTITION PLATES

[75] Inventor: Eijiro Toyota, Tokyo, Japan

[73] Assignee: Sumitomo Heavy Industries, Inc., Tokyo, Japan

[21] Appl. No.: 09/049,229

[22] Filed: Mar. 27, 1998

[30] Foreign Application Priority Data

Apr. 4, 1997 [JP] Japan ..... 9-100844

[51] Int. Cl.[7] ..... G21K 5/00

[52] U.S. Cl. ..... 378/34; 378/145

[58] Field of Search ..... 378/34, 145

[56] References Cited

U.S. PATENT DOCUMENTS 5,031,199 7/1991 Cole et al. ..... 378/34

*Primary Examiner*—Craig E. Church
*Attorney, Agent, or Firm*—Frishauf, Holtz, Goodman, Langer & Chick, P.C.

[57] ABSTRACT

X-rays transmit through a vacuum duct along an axial direction of the vacuum duct. A plurality of first partition plates are disposed in the vacuum duct. Each of the first partition plates is formed with a first through hole at a central area thereof. The first partition plates divide the inner space of the vacuum duct in the axial direction and define a plurality of partitioned spaces. A plurality of second partition plates are provided each corresponding to each of the first partition plates. The second partition plate is disposed at a certain gap relative to a corresponding one of the first partition plates, each of the second partition plates being formed with a second through hole at a central area thereof, the X-rays transmitting through the vacuum duct passing through the second through hole. A support member connects the second partition plates together and fixes a relative position of the second partition plates. A support member driving unit supports the support member in the inner space of the vacuum duct and drives the support member to move the second partition plates in accordance with a swing of a central axis of a flux of the X-rays transmitting through the inner space of the vacuum-duct. A film hermetically seals an output end of the vacuum duct and transmits the X-rays therethrough.

11 Claims, 9 Drawing Sheets

9
7
8
2
1
9
2'
7
5
23
57
$6_2$
10
8
7'
D
10
$6_1$
4
3

ACOUSTIC DELAY LINE WITH MOVABLE PARTITION PLATES

This application is based on Japanese Patent Application No. Hei 9-100844 filed on Apr. 4, 1997, the entire contents of which are incorporated herein by reference.

BACKGROUND OF THE INVENTION a) Field of the Invention

The present invention relates to an acoustic delay line, and more particularly an acoustic delay line provided along a beam line.

b) Description of the Related Art

FIG. 9 is a schematic diagram showing a general X-ray exposure system using synchrotron radiation. A synchrotron 50 shown as a sketch moves an electron beam circularly in the horizontal plane in an ultra high vacuum. Synchrotron radiation is generated in a direction tangent to the circular orbit. Radiated light 52 from the synchrotron 50 is introduced into a vacuum duct 53. Installed around this vacuum duct 53 are a vacuum shutter valve 65, a high speed vacuum shutter valve 66, and if necessary, an unrepresented block shutter for blocking radiated light, an unrepresented vacuum pump and the like. A mirror box 54 is connected at a downstream position of the vacuum duct 53.

An X-ray mirror 55 is disposed in the mirror box 54, at an angle of 1 to 2 degrees relative to incidence light having an incidence angle of 89 to 88 degrees. The reflection plane of the X-ray mirror 55 is plane, cylindrical, toroidal, or the like. The surface of the reflection plane is usually coated with gold, platinum or the like. The X-ray mirror 55 downstream reflects about 60 to 70% of the incidence light, and removes short wavelength components (hard X-rays) which are not suitable for X-ray exposure. The X-ray mirror 55 is pivoted by a driver 56, in the horizontal plane about an axis passing through a reflection reference point 0 and being perpendicular to a center optical axis of the radiated light 52. Although the light 52 is irradiated omnidirectionally in the horizontal plane, it has only a spread of about 1 mrad (mili-radian) in the vertical plane. By pivoting the X-ray mirror 55, the reflected light is scanned in the vertical direction so that an exposure field can be broadened.

Another vacuum duct 57 is connected at a downstream position of the mirror box 54. This vacuum duct 57 is partially or wholly constituted of a beam line large-diameter outer tube unit 63. The inside of the beam line large-diameter outer tube unit 63 is divided into several to several tens sections by partition plates 64. A rectangular or circular hole is formed in the central area of each partition plate 64 to thereby define an acoustic delay line. As gas is introduced from one end of the acoustic delay line into the inside thereof, each partition plate 64 functions as a flow absorber. The gas is temporarily trapped in each section divided by the partition plates 64, and a gas inflow speed along the axial direction of the acoustic delay line is lowered. At the downstream end of the vacuum duct 57, a beryllium thin film 59 as a radiated light output port is provided which is bonded to a flange 58. A sensor head 67 of a vacuum gauge is mounted on the vacuum duct 57 near at the beryllium thin film 59. The beryllium thin film 59 is about 30 $\mu$m in thickness, providing a function of transmitting radiated light in vacuum to the atmosphere and a filter function of removing longer wavelength components (ultraviolet rays in vacuum) which are not suitable for X-ray exposure. Pressure data measured with the head sensor 67 of the vacuum gauge is supplied to a controller 80 which monitors the input pressure data and when it exceeds a predetermined value, closes the shutter valves 65 and 66.

Radiated light transmitted through the beryllium thin film 59 to the atmosphere passes through an X-ray mask 60, and exposes resist (photosensitive material) coated on the surface of a wafer 61 to thereby transfer a pattern drawn on the X-ray mask onto the resist. The outer surface of the beryllium thin film 59 is exposed to the atmosphere, pressure reduced air, or to helium gas easy to transmit X-rays. A distance between the X-ray mask 60 and wafer 61 is 10 to 20 $\mu$m. The wafer 61 is held by a movable table of an X-ray stepper 62. The exposure position of the wafer is changed each time exposure is performed to enable sequential proximity exposure.

The beryllium thin film 59 may be broken by a temperature rise or deterioration of the film to be caused through absorption of X-rays, or by inadvertent handling by an operator. When the beryllium thin film 59 is broken, the external atmosphere (air or helium gas) flows into the vacuum duct 57 and lowers the vacuum degree of the beam line. The vacuum degree of the inside of the synchrotron 50 is also lowered and running the system may become impossible. In order to avoid such accidents, the beam line large-diameter outer tube unit 63 is provided with the acoustic delay line, the sensor head 67 of the vacuum gauge is disposed near the beryllium thin film 59, and at the upstream positions of the beam line, the high speed vacuum shutter valve 66 and the shutter valve 65 having a perfect sealing performance although it cannot operate at high speed, are used. When the beryllium thin film is broken, a pressure value measured with the sensor head 67 of the vacuum gauge rises so that the controller 80 detects a lowered vacuum degree and closes both the high speed vacuum shutter valve 66 and shutter valve 65 at the same time, to thereby protect the upstream vacuum system.

A time taken to completely close the high speed shutter valve 66 in response to a sensor signal is generally several tens ms, and the speed of molecules of entering gas is 500 (air) to 1500 (helium) m/s. Assuming that the length of the beam line is 10 m, the gas reaches the high speed shutter valve 66 in 7 to 20 ms. The acoustic delay line temporarily traps most of the entering gas in the large-diameter space and delays an arrival of the entering gas to the high speed shutter valve. However, as the exposure area becomes large, the size of a through hole formed in the partition plate 64 of the acoustic delay line also becomes large. It becomes therefore difficult to trap gas during a sufficient time.

SUMMARY OF THE INVENTION

It is an object of the present invention to provide an acoustic delay line capable of delaying gas transport to the upstream when a vacuum state is destructed at the output port of a beam line.

According to one aspect of the present invention, there is provided an acoustic delay line comprising: a vacuum duct for defining an inner space in which X-rays transmit along an axial direction of the vacuum duct; a plurality of first partition plates disposed in the vacuum duct, each of the first partition plates being formed with a first through hole at a central area thereof, the X-rays transmitting through the vacuum duct passing through the first through hole, the plurality of first partition plates dividing the inner space of the vacuum duct in the axial direction and defining a plurality of partitioned spaces; a plurality of second partition plates each provided in correspondence with each of the first partition plates, each of the second partition plates being disposed at a certain gap relative to a corresponding one of the first partition plates, each of the second partition plates being formed with a second through hole at a central area thereof, the X-rays transmitting through the vacuum duct passing through the second through hole, an opening area of the second through hole being smaller than an opening area of the first through hole; a support member connecting the second partition plates together and fixing a relative position of the second partition plates; support member driving means for supporting the support member in the inner space of the vacuum duct and driving the support member to move the second partition plates in accordance with a swing of a central axis of a flux of the X-rays transmitting through the inner space of the vacuum duct; and a film for hermetically sealing an output end of the vacuum duct and transmitting the X-rays.

The first partition plate and its corresponding second partition plate are disposed near each other at a predetermined gap therebetween. Therefore, the two adjacent partitioned spaces communicate with each other substantially via the second through hole only. An opening area of the second through hole is smaller than the opening area of the first through hole of the first partition plate. Namely, provision of the second partition plate can increase a flow resistance of gas passing between the partitioned spaces so that the performance of the acoustic delay line can be maintained high.

DETAILED DESCRIPTION OF THE PREFERRED EMBODIMENTS

Figure 1:
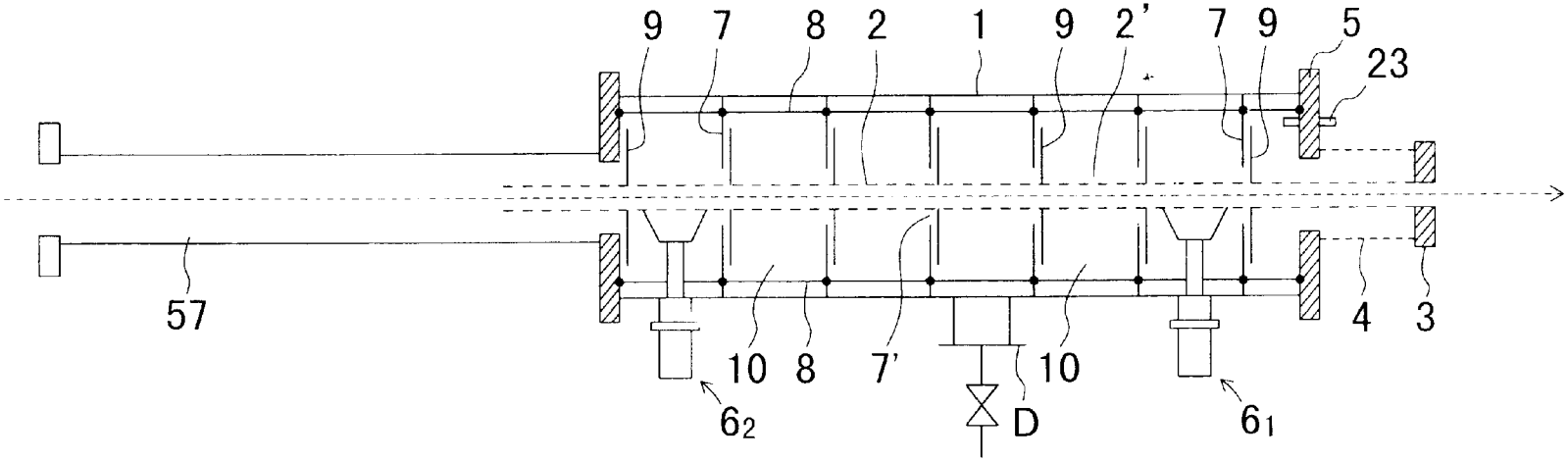
FIG. 1 is a schematic cross sectional view of an acoustic delay line according to an embodiment of the invention.

FIG. 1 is a schematic cross sectional view of an acoustic delay line of a beam line according to an embodiment of the invention. This acoustic delay line is used, for example, in place of the vacuum duct 57 of the X-ray exposure system shown in FIG. 9. At the downstream of the mirror box 54 shown in FIG. 9, a vacuum duct 57 is connected, at the downstream of which a beam line large-diameter outer tube unit 1 is connected. An inner tube 2 is installed inside of the large-diameter outer tube unit 1. The inner tube 2 is used as an envelope of an optical path of radiated light. A radiated light output frame 3 is coupled to the tip of the inner tube 2 on the downstream side thereof. A flange 5 mounted at the downstream end of the large-diameter outer tube unit 1 and the radiated light output frame 3 are hermetically sealed by a vacuum bellows 4. Drivers $\mathbf{6}_1$ and $\mathbf{6}_2$ are mounted on the lower wall of the large-diameter outer tube unit 1 at opposite end portions. The drivers $\mathbf{6}_1$ and $\mathbf{6}_2$ drive the inner tube 2 in a vertical direction while supporting it. The inner tube 2 is driven synchronously with a pivotal motion of the mirror 55 (FIG. 9) to establish an optical path of radiated light.

A plurality of partition plates 7 are disposed inside of the large-diameter outer tube unit 1 at a predetermined pitch along the axial direction. Each of these partition plates 7 is formed with an opening 7' at the central area of the plate, the opening 7' having a size not to obstruct the up/down motion of the inner tube 2. These juxtaposed partition plates 7 are coupled together by coupling bolts 8. A plurality of partition plates 9 are formed on the outer circumference of the inner tube 2 at positions corresponding to the partition plates 7. Each pair of the partition plates 7 and 9 is preferably disposed at a gap of 1 mm or smaller. The partition plates 7 and 9 divide the inner space of the large-diameter outer tube unit 1 into a plurality of partitioned spaces 10. A number of holes 2' are formed in the upper and lower walls of the inner tube 2 to communicate each partitioned space with the inner space of the inner tube 2. Although the number, size and shape of holes 2' is optional, it is preferable to set the total opening area of holes 2' in one partitioned space 10 larger than the opening area of the inner tube 2 in the cross section vertical to the center axis of the tube 2, and it is more preferable to set the former ten times larger than the latter. The inside of the large-diameter outer tube unit 1 is evacuated via a vacuum exhaust port D formed in the wall of the large-diameter outer tube unit 1 at generally the central partitioned space 10.

Figure 2:
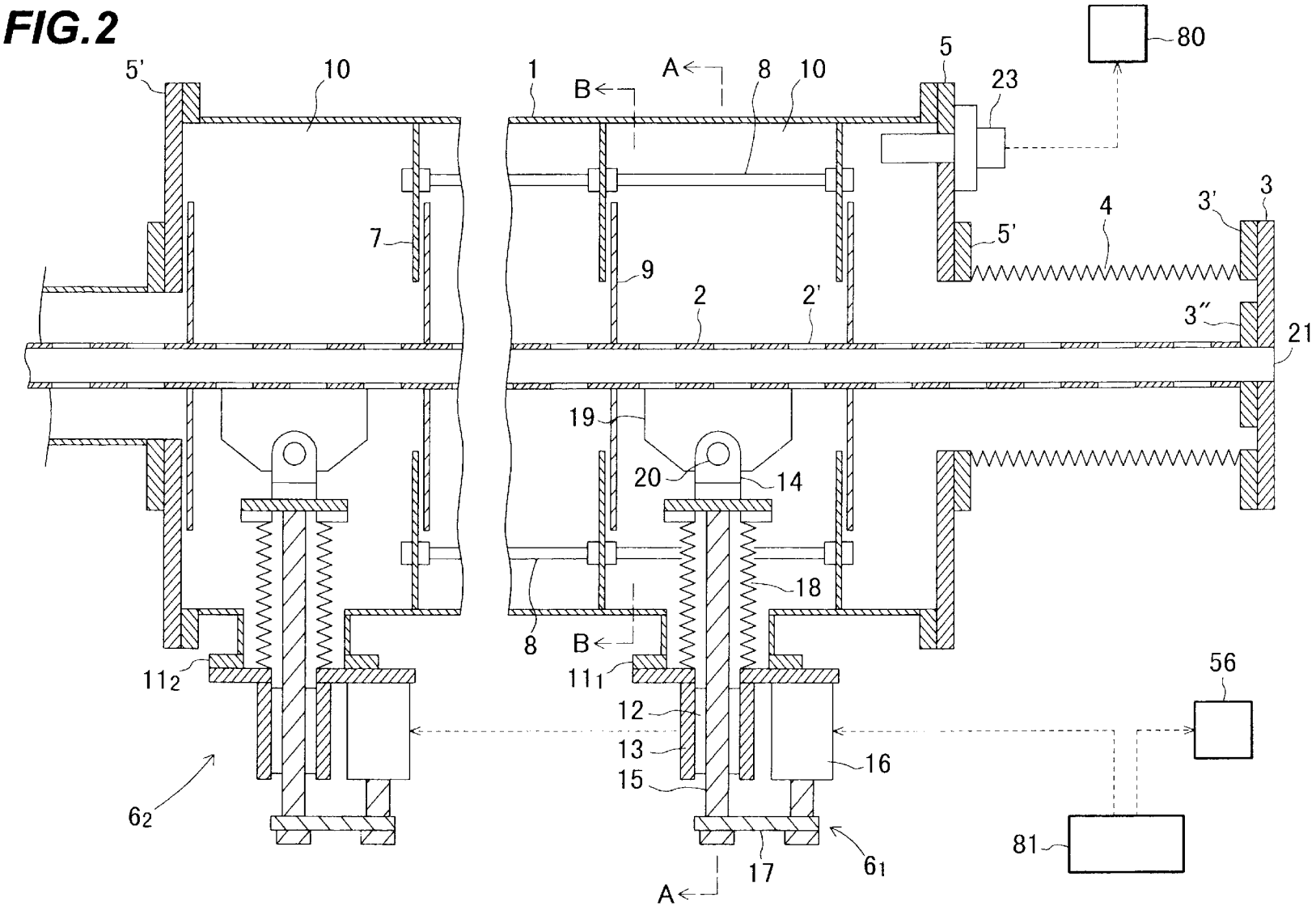
FIG. 2 is a cross sectional view showing the details of a partial area of the acoustic delay line shown in FIG. 1.
Figure 3:
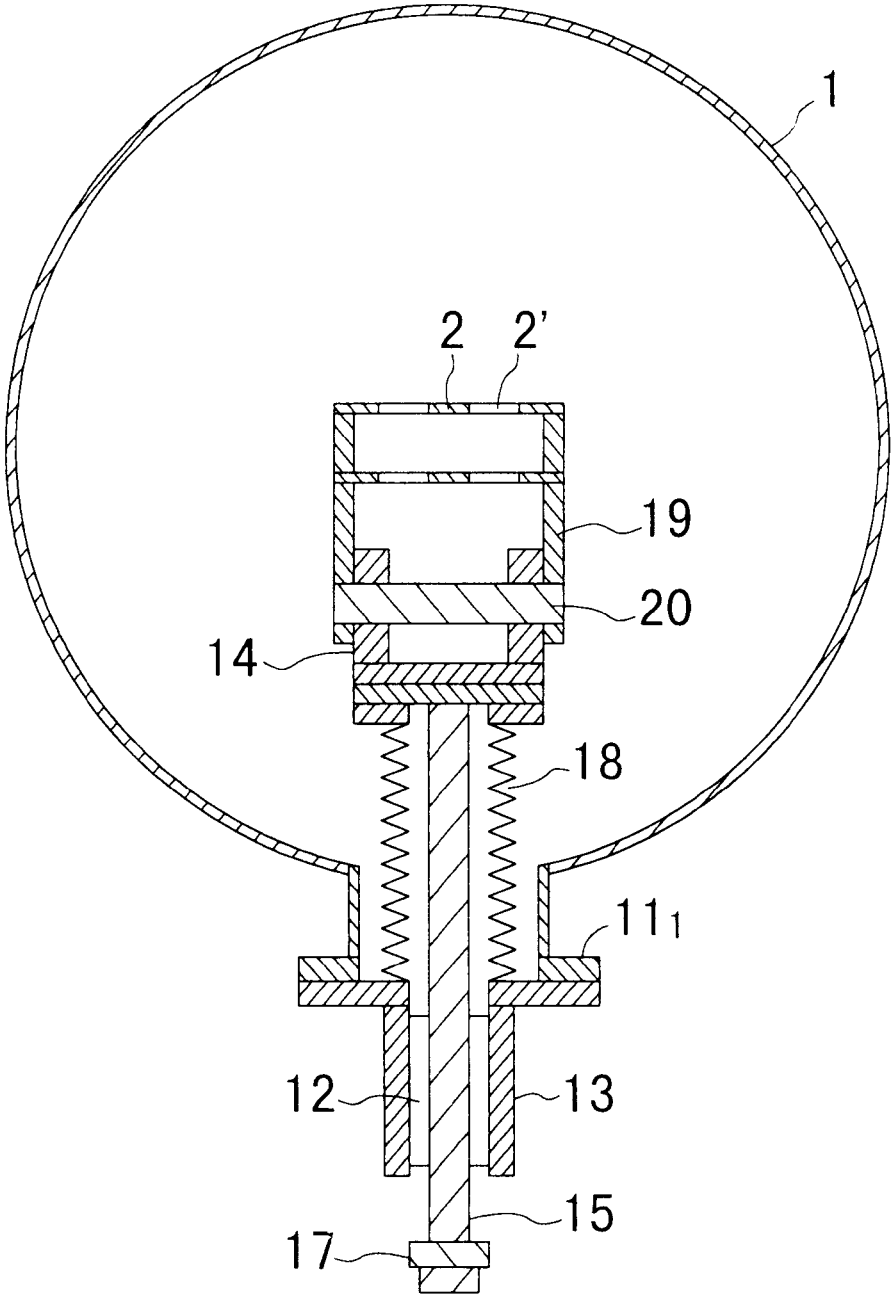
FIG. 3 is a cross sectional view taken along one-dot chain line A—A shown in FIG. 2.

The detailed structure of the beam line of this embodiment will be described with reference to FIGS. 2 to 4. FIG. 2 is a vertical cross sectional view of the beam line, taken along the center axis of the beam line, and FIGS. 3 and 4 are cross sectional views taken along respective one-dot chain lines A—A and B—B shown in FIG. 2.

Each of the drivers $\mathbf{6}_1$ and $\mathbf{6}_2$ for the inner tube 2 is constituted of: a bearing case 13 with an internal linear guide bearing 12; a guide shaft 15 having a fork at its one end; a linear actuator 16 fixed to the bearing case 13; a coupling plate 17 for coupling the movable part of the actuator 16 and the guide shaft 15; and a vacuum bellows 18. The vacuum bellows 18 is coupled between the one end of the guide shaft 15 and the bearing case 13 to retain the vacuum degree of the inside of the large-diameter outer tube unit 1. The bearing cases 13 of the drivers $\mathbf{6}_1$ and $\mathbf{6}_2$ are mounted on flanges $\mathbf{11}_1$ and $\mathbf{11}_2$ provided at the lower wall of the large-diameter outer tube unit 1. Coupling plates 19 are fixed to the forks 14 of the inner tube 2. Each coupling plate 19 and corresponding fork 14 are coupled together by a pin 20.

The radiated light output frame 3 has a disk-like shape, and a rectangular or arc-shaped window matching a cross section of a radiated light flux is formed in the frame 3 at its central area. The window is hermetically sealed with a beryllium thin film 21 which is welded or soldered to the output frame 3. The output frame 3 is coupled to the flange 5 of the large-diameter outer tube unit 1 via the vacuum bellows 4 and flanges 3' and 5'. As shown in FIGS. 3 and 4, the cross section of the inner tube 2 has a shape covering the radiated light flux. As shown in FIG. 2, one end of the inner tube 2 is mounted on a flange 3" of the radiated light output frame 3, and the other end thereof protrudes from the large-diameter outer tube unit into the upstream vacuum duct 5. The drivers $\mathbf{6}_1$ and $\mathbf{6}_2$ drive the inner tube 2 in the vertical direction and receive a force in the horizontal direction generated by a pressure difference between the atmospheric pressure applied to the radiated light output frame 3 and the vacuum pressure in the large-diameter outer tube unit 1. The drivers $\mathbf{6}_1$ and $\mathbf{6}_2$ are driven by a signal supplied from a synchronizing means 81, synchronously with the operation of the driver 56 shown in FIG. 9.

Figure 4:
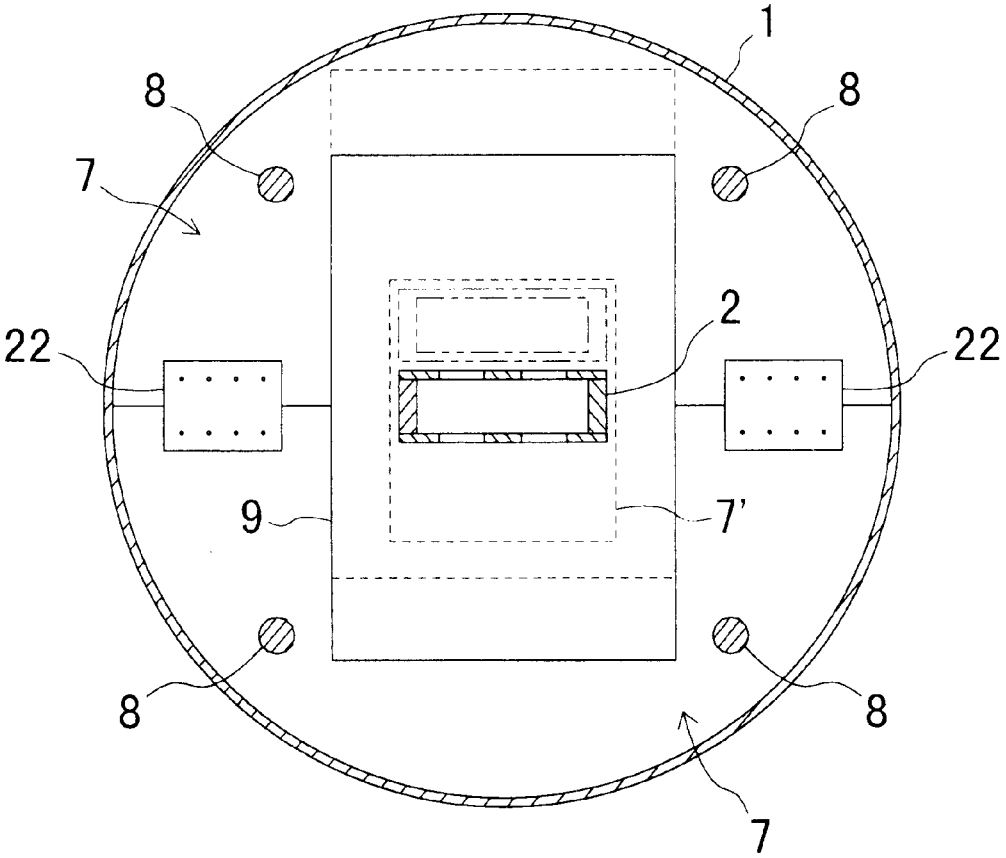
FIG. 4 is a cross sectional view taken along one-dot chain line B—B shown in FIG. 2.
Figure 9:
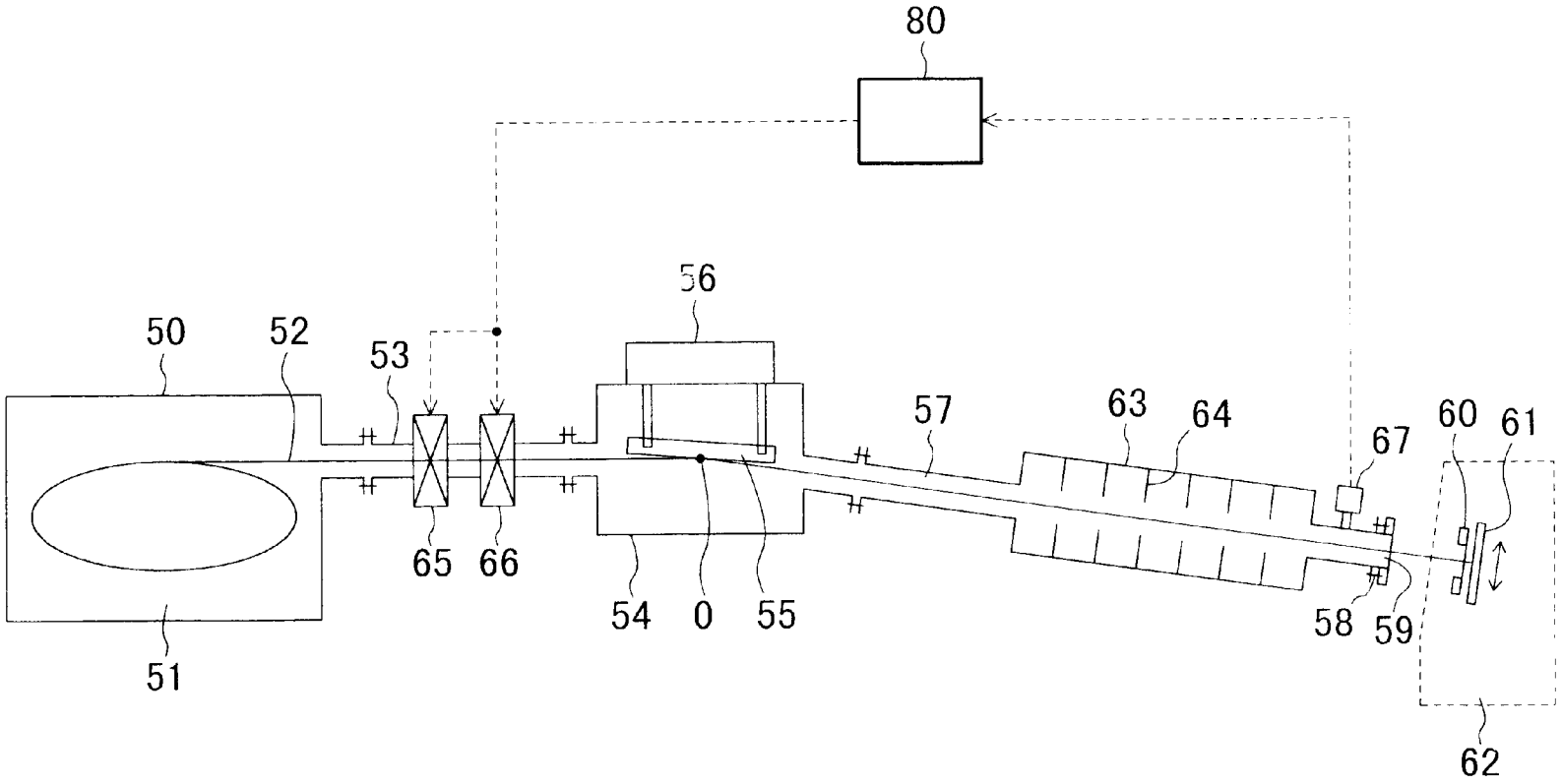
FIG.9 PRIOR ART
FIG. 9 is a schematic cross sectional view of a conventional X-ray exposure system using synchrotron radiation.

As shown in FIG. 4, for the convenience of assembly, each partition plate 7 of the large-diameter outer tube unit 1 is divided into upper and lower pieces which are coupled together by coupling plates 22 with screws. After the inner tube 2 and partition plates 9 are assembled integrally, they are assembled in the large-diameter outer tube unit 1. A sensor head 23 of a vacuum gauge is mounted on the flange 5. The sensor head 23 measures the vacuum degree in the large-diameter outer tube unit 1 and supplies the measured data to the controller 80 (FIG. 9). The controller 80 monitors a change in the vacuum degree, and when the beryllium thin film is broken, it operates to actuate the high speed shutter valve 66 and shutter valve 65 (FIG. 9) at the upstream positions. It is therefore possible to prevent gas from entering the inside of the synchrotron. The size of the large-diameter outer tube unit constituting the acoustic delay line is about 400 mm in outer diameter and about 2 m in length.

In the large-diameter outer tube unit 1 shown in FIG. 1, the two adjacent partitioned spaces 10 communicate with each other via the holes 2' formed in the upper and lower walls of the inner tube 2 and via the internal space of the inner tube 2. If the total opening area of holes 2' in one partitioned space 10 is ten times or more of the cross sectional area of the inner space of the inner tube 2, a resistance applied to the gas flowing between the inner space of the inner tube 2 and its partitioned space 10 is sufficiently small as compared to a resistance applied to the gas flowing through the inner space of the inner tube 2 along its axial direction. Therefore, the structure shown in FIG. 1 can be considered as substantially equivalent to the structure that the two adjacent partitioned spaces 10 communicate with each other via a hole having a cross sectional area of the inner space of the inner tube 2.

If the inner tube 2 is not used, the partition plates 9 cannot be mounted so that the two adjacent partitioned spaces 10 communicate with each other via the opening 7'. The cross sectional area of the inner space of the inner tube 2 is smaller than the area of the opening 7'. Therefore, the resistance of the gas flowing in the axial direction increases, and a transport speed of the gas flowing in the large-diameter outer tube unit 1 in its axial direction can be lowered.

Next, another embodiment will be described with reference to FIGS. 5 to 8. In the system shown in FIG. 1, the inside of the large-diameter outer tube unit 1 is divided into a plurality of partitioned spaces 10 by the partition plates 7 and 9 superposed at a small gap, and each pair of adjacent partitioned spaces 10 communicates via the inner space of the inner tube 2 and the holes 2' formed in the upper and lower walls of the inner tube 2. It takes, therefore, a long time to evacuate the gas in each partitioned space from the vacuum exhaust port D and obtain a predetermined vacuum degree, when the inside of the large-diameter outer tube unit 1 is evacuated at the initial running stage.

Figure 5:
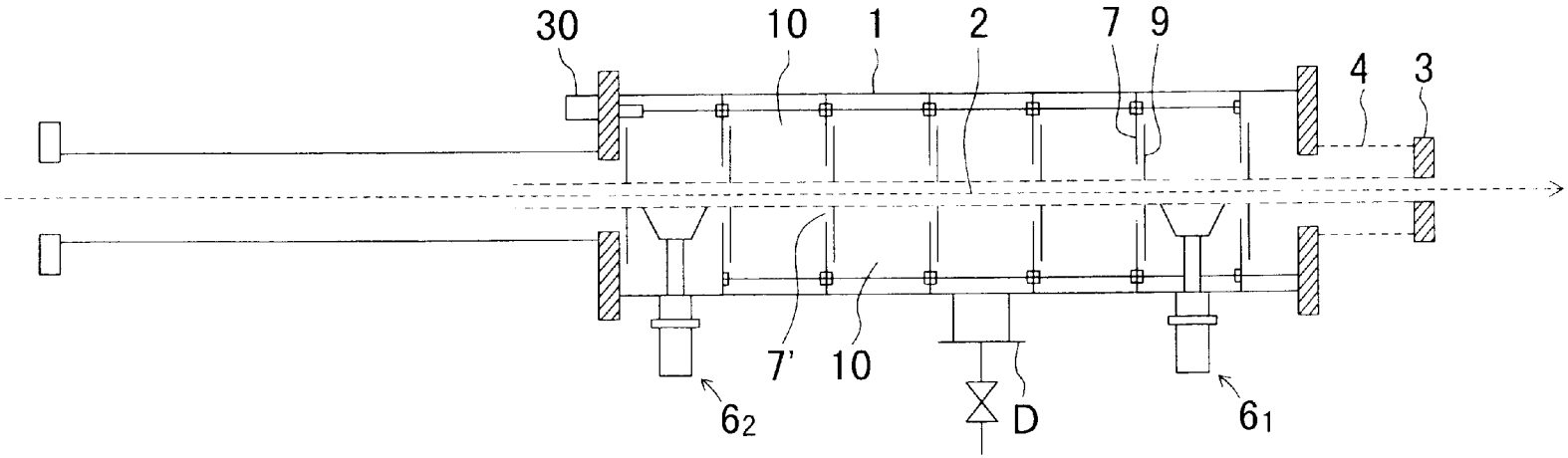
FIG. 5 is a schematic cross sectional view of an acoustic delay line according to another embodiment of the invention.

FIG. 5 is a schematic cross sectional view of a large-diameter outer tube unit capable of increasing an evacuation speed, according to another embodiment. When the inside of the large-diameter outer tube unit 1 is to be evacuated, the partition plates 7 are driven by a driver 30 to move them in the axial direction of the large-diameter outer tube unit and broaden a gap between the partition plates 7 and 9. In this manner, the evacuation speed can be increased.

Figure 6:
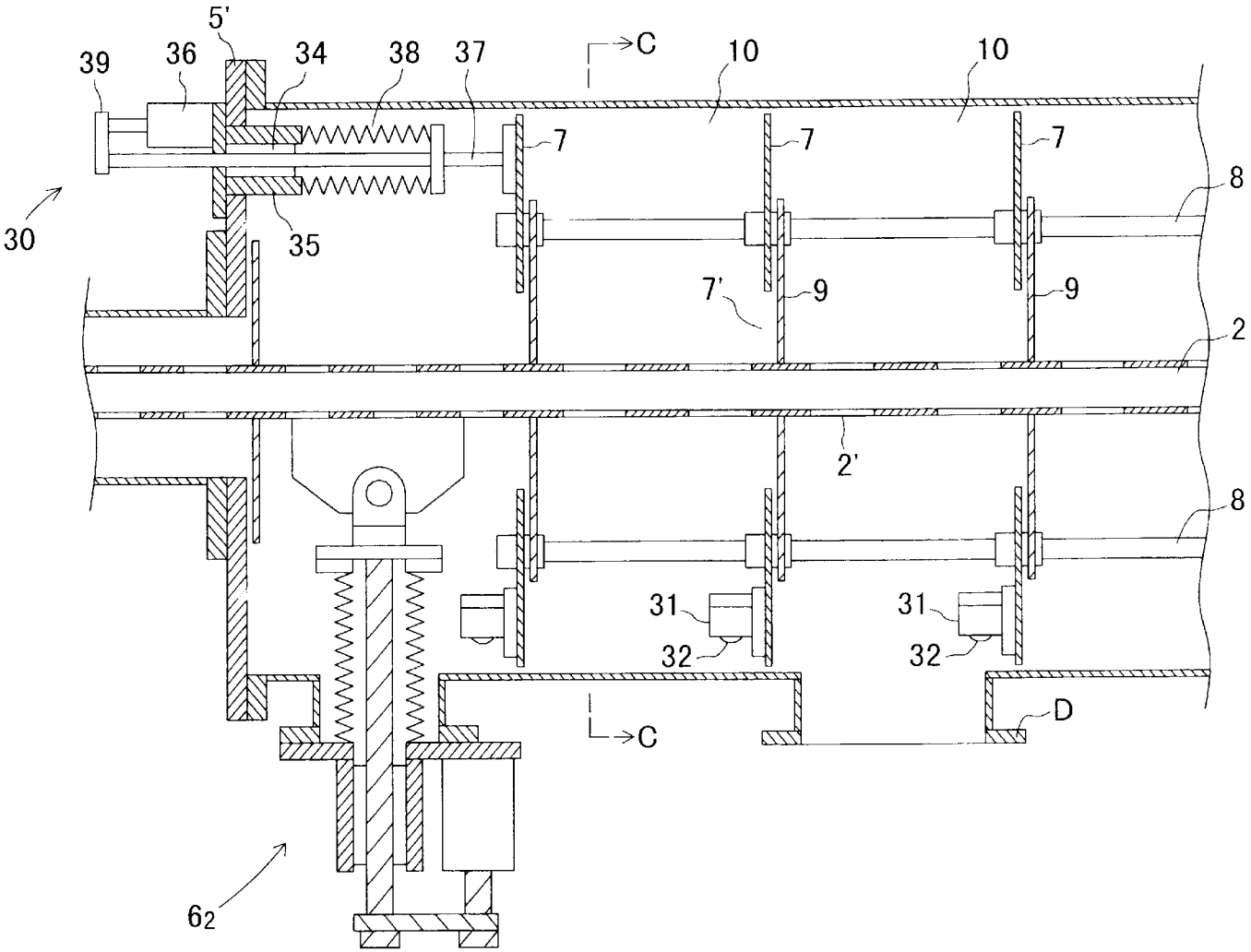
FIG. 6 is a cross sectional view showing the details of a partial area of the acoustic delay line shown in FIG. 5.
Figure 7:
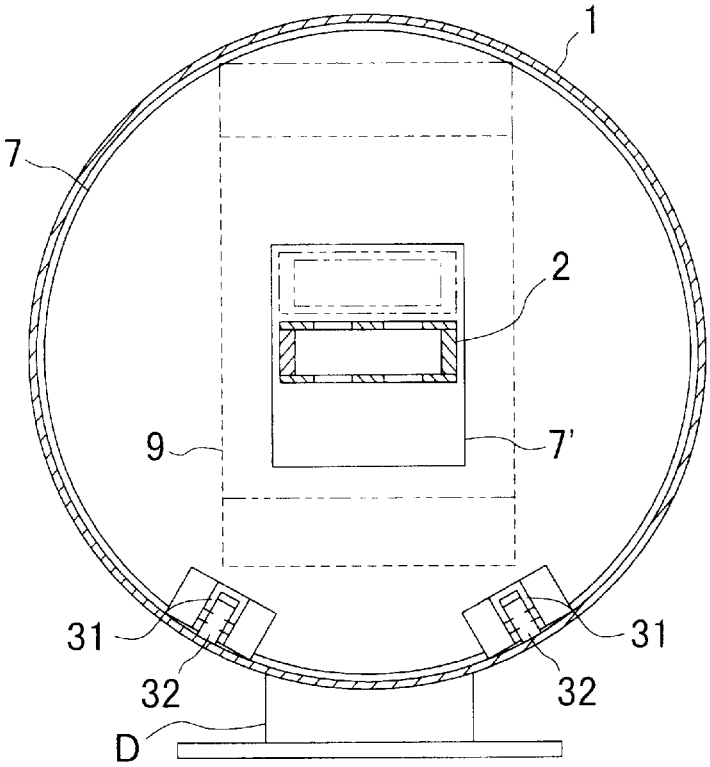
FIG. 7 is a cross sectional view taken along one-dot chain line C—C shown in FIG. 6.
Figure 8:
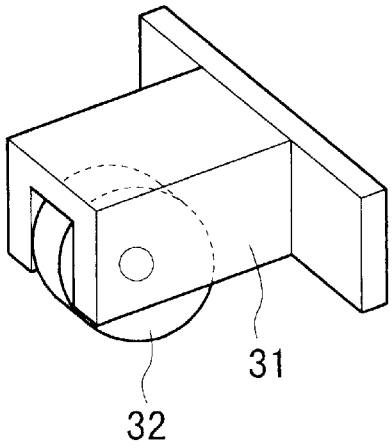
FIG. 8 is a perspective view of a roller mount of the acoustic delay line shown in FIG. 6.

The detailed structure of the large-diameter outer tube unit of this embodiment will be described with reference to FIGS. 6 to 8. FIG. 6 is a vertical cross sectional view of the large-diameter outer tube unit 1 taken along the center axis of the unit 1, and FIG. 7 is a cross sectional view taken along one-dot chain line C—C of FIG. 6.

As shown in FIG. 6, the partition plates 7 are coupled together by a bolt 8. Two brackets 31 are mounted on the lower portion of each partition plate 7. Each bracket 31 has a roller 32 mounted rotatively. FIG. 8 is a perspective view showing the bracket 31 and roller 32. As shown in FIG. 7, the roller 32 becomes in contact with the inner circumference of the large-diameter outer tube unit 1 to movably support the partition plate in the axial direction. As the roller 32 rolls on the inner circumference of the large-diameter outer tube unit 1, the partition plate 7 can move in the axial direction.

The driver 30 for moving the partition plates 7 has a similar structure to those of the drivers $\mathbf{6}_1$ and $\mathbf{6}_2$ of the inner tube 2 of the first embodiment. Specifically, the driver 30 is constituted of: a bearing case 35 with an internal linear guide bearing 34; a linear actuator 36 fixed to the bearing case 35; a coupling shaft 37 coupled to the outermost partition plate 7; a vacuum bellows 38 for vacuum sealing the space between the coupling shaft 37 and bearing case 35; and a coupling plate 39 for coupling the actuator 36 and coupling shaft 37. The bearing case 35 of the driver 30 is mounted on a flange 5' of the large-diameter outer tube unit 1.

The linear actuator 36 has a function of making the motion of the partition plates stop at opposite ends of a motion stroke and a function of generating an electric interlock signal, which indicates the operating status of the beam line.

In operation, prior to evacuating the inside of the large-diameter outer tube unit 1, the linear actuator 36 is driven to move the coupling shaft to the left as viewed in FIG. 6. The partition plates 7 therefore move to the left and a space to a corresponding partition plate 9 mounted on the outer circumference of the inner tube 2 is broadened as shown in FIG. 5. In this state, the gas in the large-diameter outer tube unit 1 is discharged from the vacuum exhaust port D, so that the vacuum degree of the inside of the large-diameter outer tube unit 1 can be set to an operating value in short time. After the vacuum degree of the inside of the large-diameter outer tube unit 1 is set to the operating value, the linear actuator 36 is again driven to move the coupling shaft to the right as viewed in FIG. 5 and set each partition plate 7 near to the corresponding partition plate 9. In a state that the partition plate is set near to the corresponding partition plate 9 to such an extent as shown in FIG. 1, an exposure process starts.

In the above embodiments, since the inner tube 2 used as an envelope of a light beam flux is swung up and down by the drivers $\mathbf{6}_1$ and $\mathbf{6}_2$ synchronously with the up/down scan of the X-ray mirror, the opening of the radiated light output frame 3 can be made narrow. Accordingly, as compared to a conventional large opening, the strength of the beryllium thin film 21 is increased so that breakage thereof can be prevented.

Even if the beryllium thin film 21 is broken, there is an increased flow resistance of gas because the cross sectional area of the passage from the opening of the radiated light output frame 3 directly to the upstream is made-small.

Furthermore, the gas enters each partitioned space 10 from the holes 2' whose total area is larger than the cross sectional area of the passage, and the gas is trapped by the partitioned space 10, so that the essential function of an acoustic delay line can be provided sufficiently. Accordingly, a time taken to reach the high speed shutter valve can be prolonged, and the gas can be prevented from entering the inside of the synchrotron 50 (FIG. 9).

Figure 10:
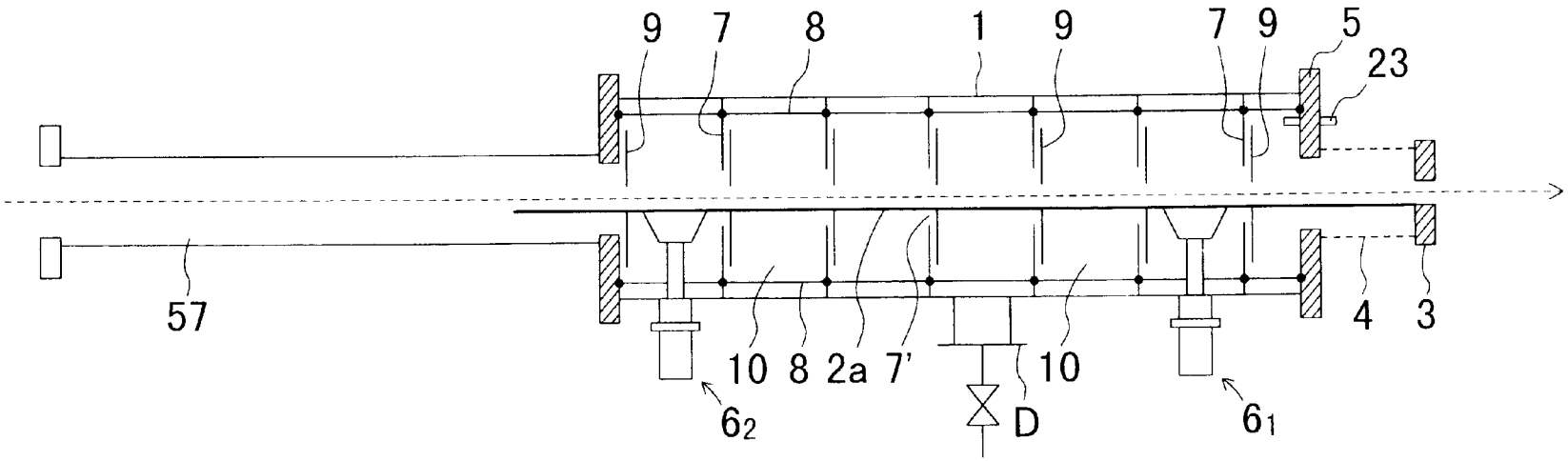
FIG. 10 is a schematic cross sectional view of a modification of the acoustic delay line shown in FIG. 1.

In the embodiments shown in FIGS. 1 and 5, the movable partitions 9 are supported by the inner tube 2. In place of the inner tube 2, a solid support member may be used for supporting the movable partitions 9. FIG. 10 is a schematic cross sectional view of a beam line in which movable partition plates 9 are supported by a solid support member 2*a*. The support member 2*a* may be only the upper portion, lower portion, or side portion of the inner tube 2 shown in FIG. 4. With this arrangement, the same advantageous effects as the embodiment shown in FIG. 1 can be expected.

The present invention has been described in connection with the preferred embodiments. The invention is not limited only to the above embodiments. It is apparent that various modifications, improvements, combinations, and the like can be made by those skilled in the art.

What is claimed is:

1. An acoustic delay line comprising:

a vacuum duct for defining an inner space in which X-rays transmit along an axial direction of said vacuum duct;

a plurality of first partition plates disposed in said vacuum duct, each of said first partition plates being formed with a first through hole at a central area thereof, the X-rays transmitting through said vacuum duct passing through the first through hole, said plurality of first partition plates dividing the inner space of said vacuum duct in the axial direction and defining,a plurality of partitioned spaces;

a plurality of second partition plates each provided in correspondence with each of said first partition plates, each of said second partition plates being disposed at a certain gap relative to a corresponding one of said first partition plates, each of said second partition plates being formed with a second through hole at a central area thereof, the X-rays transmitting through said vacuum duct passing through the second through hole, an opening area of the second through hole being smaller than an opening area of the first through hole;

a support member connecting said second partition plates together and fixing a relative position of said second partition plates;

support member driving means for supporting said support member in the inner space of said vacuum duct and driving said support member to move said second partition plates in accordance with a swing of a central axis of a flux of the X-rays transmitting through the inner space of said vacuum duct; and a film for hermetically sealing an output end of said vacuum duct and transmitting the X-rays.

2. An acoustic delay line according to claim 1, wherein said support member is disposed passing through said first partition plates via the first through holes, said support member has a tubular shape and serves as an envelope of a flux of the X-rays transmitting through said vacuum duct, and a side wall of said support member is formed with a plurality of third through holes for communicating an inner space of said support member with each of the partitioned spaces at an outside of said support member.

3. An acoustic delay line according to claim 2, wherein said film hermetically seals one end of said tubular support member, and the acoustic delay line further comprises a vacuum bellows for hermetically sealing a space between the one end of said tubular support member and a corresponding end of said vacuum duct.

4. An acoustic delay line according to claim 2, wherein a total area of said third through holes in each of the partitioned spaces is larger than a cross sectional area of the inner space of said tubular support member, the cross sectional area being perpendicular to the axial direction of said tubular support member.

5. An acoustic delay line according to claim 4, wherein a total area of said third through holes in each of the partitioned spaces is ten times or more of a cross sectional area of the inner space of said tubular support member, the cross sectional area being perpendicular to the axial direction of said tubular support member.

6. An acoustic delay line according to claim 1, further comprising a driving mechanism for driving said first partition plates in the axial direction of said vacuum duct.

7. An acoustic delay line according to claim 6, further comprising a roller mounted on each of said first partition plates, said roller being in contact with an inner circumference of said vacuum duct and supporting said first partition plate movable in the axial direction of said vacuum duct.

8. An acoustic delay line according to claim 1, further comprising:

an X-ray source disposed in a vacuum chamber;

a reflection mirror for reflecting X-rays radiated from said X-ray source and introducing the X-rays into the inner space of said vacuum duct;

a mirror box for housing said reflection mirror, an inside of said mirror box being capable of being evacuated;

a shutter valve disposed between the vacuum chamber of said X-ray source and said mirror box for intercepting a gas flow therebetween; and a mirror swinging mechanism for swinging said reflection mirror to swing a center optical axis of a flux of the X-rays reflected from said reflection mirror.

9. An acoustic delay line according to claim 8, further comprising a vacuum gauge for detecting a lowered vacuum degree in a space near the one end of the inner space of said vacuum duct.

10. An acoustic delay line according to claim 9, further comprising control means for controlling to shut said shutter valve when said vacuum meter detects a lowered vacuum degree.

11. An acoustic delay line according to claim 8, wherein said support member driving means drives said support member, synchronously with a swing of said reflection mirror made by said mirror swinging mechanism.

* * * * *